United States Patent [19]

Kahn

[11] 4,220,818

[45] Sep. 2, 1980

[54] AM STEREO TRANSMITTER

[76] Inventor: Leonard R. Kahn, 137 E. 36th St., New York, N.Y. 10016

[21] Appl. No.: 41,165

[22] Filed: May 21, 1979

[51] Int. Cl.[2] ..... H04H 5/00

[52] U.S. Cl. ..... 179/1 GS; 332/17; 332/40; 332/41

[58] Field of Search ..... 179/1 GS; 325/36, 47, 325/139; 332/17, 21, 22, 23 R, 23 A, 40, 41, 48

[56] References Cited

U.S. PATENT DOCUMENTS

| | | | |
|---|---|---|---|
| 2,903,518 | 9/1959 | Kahn | 179/1 GS |
| 3,803,490 | 4/1974 | Almering et al. | 179/1 GS |
| 3,908,090 | 9/1975 | Kahn | 325/36 |

*Primary Examiner*—Douglas W. Olms

[57] ABSTRACT

A transmitter for an independent sideband (ISB) AM stereo system is provided with a phase modulator which includes means for generating second order upper and lower sidebands which are proportional to the stereo difference signal. No second order upper and lower sidebands are generated when the L and R audio signals are equal. The phase modulator uses an ISB suppressed carrier signal generator and a quadrature demodulator which demodulates the quadrature component of the output of the ISB generator. This demodulated component is used in a balanced modulator to modulate the ISB signal and thereby generate a signal having a carrier and upper and lower first and second order sidebands. This signal is combined with a carrier signal of selected amplitude and the ISB suppressed carrier signal to provide an output signal which, after limiting, is a phase-modulated signal having first and second order upper and lower sidebands. When the L and R signals are equal, all of the sidebands of this signal vanish. The phase modulated signal is amplitude modulated using an audio signal corresponding to the summation of the L and R stereo signals.

8 Claims, 2 Drawing Figures

AM STEREO TRANSMITTER

BACKGROUND OF THE INVENTION

This invention relates to independent sideband (ISB) AM stereo transmitters and particularly to such transmitters wherein second order upper and lower sidebands are provided in the phase-modulated signal to provide a suitable composite transmitted signal which can be demodulated in the receiver either as a monaural or a stereo signal without distortion.

U.S. Pat. No. 3,908,090 describes a transmitter for an ISB AM stereo signal wherein the left and right hand stereo information is transmitted substantially only on the lower and upper sidebands, respectively. The system therein described includes apparatus for generating second order upper and lower sidebands to obtain distortion-free transmission and reception and provide good stereo separation of approximately 30 dB.

U.S. Pat. No. 3,952,251 discloses a compatible single sideband transmitter wherein the transmitter generates a first order sideband for higher frequency audio components and first and second order sidebands for lower frequency audio components. The second order sideband is generated by modulating a signal comprising the first order sideband in a balanced modulator utilizing a modulating signal which is obtained by demodulating the single sideband signal using the carrier.

It is an object of the present invention to provide an independent sideband AM stereo system having improved sideband separation and good spectral cleanliness.

SUMMARY OF THE INVENTION

In accordance with the present invention, an independent sideband (ISB) AM stereo transmitter is provided with a phase modulator which includes an ISB suppressed carrier signal generator which responds to supplied stereo signals L and R, and a supplied carrier signal, for modulating the carrier and generating a first suppressed carrier signal having upper and lower first order sidebands separately modulated by the L and R signals. The ISB signal is provided to a product demodulator, which also responds to the carrier signal and demodulates the quadrature component of the ISB signal to form a second signal. There are provided means for modulating the first ISB signal with the second signal to form a third signal which has first order sideband components and carrier and second order sideband components proportional to the second signal. The carrier signal, the first signal and the third signal are combined with selected amplitudes and phases to form a fourth signal which is supplied to a limiter for removing the amplitude modulation components, thereby to provide a phase-modulated signal having a carrier and first and second order sideband components.

For a better understanding of the present invention, together with other and further objects, reference is made to the following description, in conjunction with the accompanying drawings, and its scope will be pointed out in the appended claims.

DESCRIPTION OF THE INVENTION

Figure 1:
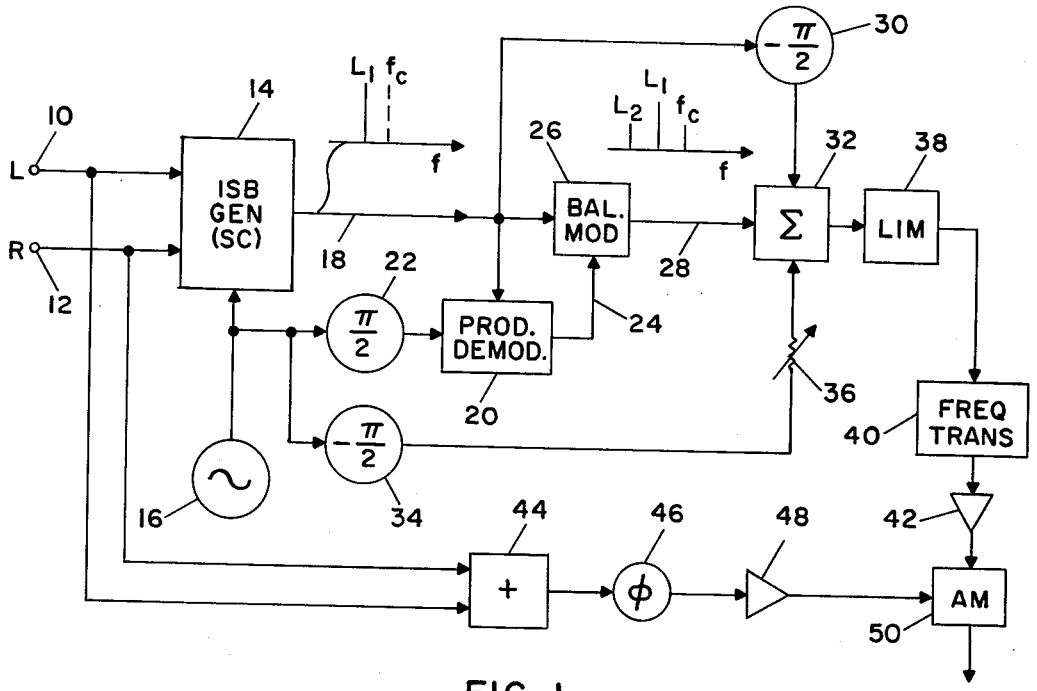
FIG. 1 is a block diagram of an AM stereo transmitter in accordance with the present invention.

Referring generally to the block diagram of FIG. 1 there is shown an AM stereo signal transmitter in accordance with the present invention. Left and right separate audio signals are provided to terminals 10 and 12 of the transmitter. These signals and a carrier from oscillator 16 are provided to independent sideband (ISB) suppressed carrier signal generator 14, which generates a first intermediate signal on line 18 with a suppressed carrier and upper and lower first order sidebands, each proportional to a stereo audio signal. Thus, as indicated by the simplified illustrative graph adjacent line 18, left stereo information L is carried on a lower sideband while right stereo information R, when present, is carried on an upper sideband and the carrier is suppressed to zero amplitude.

The carrier from oscillator 16 is also supplied to phase shifter 22 and then supplied to product demodulator 20 with a quadrature phase. Product demodulator 20 makes use of this quadrature phase carrier signal from phase shifter 22 to perform a quadrature demodulation of the first intermediate signal. The demodulated quadrature component is a second intermediate signal and has an amplitude proportional to the difference between the R and L audio signals, and vanishes for equal R and L signals. The second intermediate signal is supplied over line 24 to balanced modulator 26, which is also supplied with the first intermediate signal from ISB generator 14. Balanced modulator 26 acts on the first intermediate signal and modulates it with the second intermediate signal supplied on line 24 to generate a third intermediate signal, which is the output on line 28. For each of the components, comprising upper and lower first order sidebands R and L in the first intermediate signal supplied on line 18, balanced modulator 26 generates a component at the same frequency as the supplied signal R or L and generates upper and lower sideband components. Since the frequency of the second intermediate signal supplied on line 24 is the same as the R and L audio signals which are used to generate the original first order independent sidebands of the first intermediate signal, the output on line 28 will have a component at the original carrier frequency and will also have components at the first and second order upper and lower sidebands of the carrier according to the audio modulation frequency. The upper and lower sideband components, each consisting of first and second order sidebands, are representative of right and left stereo information, respectively, and are separated so that the lower sidebands are representative of left stereo information, while the upper sidebands are representative of right stereo information.

The third intermediate signal, output from modulator 26, is supplied to adding circuit 32. The carrier signal, which is phase shifted by phase shifter 34, is supplied to adding circuit 32 with an amplitude selected by variable resistor 36. Also supplied to adding circuit 32 is the first intermediate signal generated by signal generator 14, which is phase shifted in phase shift network 30. These signals are combined with selected amplitude and phase in adding circuit 32 to provide an output signal which has components at the upper and lower first and second order sidebands as well as the carrier frequency. This composite signal is supplied to limiter 38, which removes the amplitude modulation component of the composite signal to provide a phase-modulated signal with the upper and lower first and second order sidebands. It should be noted that if the R and L audio signals are identically equal, limiter 38 will remove the sidebands and provide only a carrier as the output signal. The phase modulated signal from limiter 38 is frequency translated (as required) to an appropriate RF frequency in circuit 40, amplified in amplifier 42, and finally amplitude modulated in conventional modulator 50. Amplitude modulator 50 is supplied with a stereo sum signal, which comprises the sum of the L and R signals, which is generated in adding circuit 44, phase shifted in phase shift network 46, and amplified in amplifier 48. Network 46 introduces time delay, if required, to compensate for the phase length of the phase modulation circuit.

As mentioned above, the output from limiter 38 comprises only a carrier signal when the right and left audio signals are identically equal. This is the case of monaural transmission. In this event, the carrier signal is amplitude modulated with the sum of the two equal R and L signals in amplitude modulator 50, and transmitted in a conventional manner. Thus, in the case of monaural transmission, there are no second order upper or lower sidebands transmitted. In the case of stereo transmission, the second order upper and lower sidebands are required in order to prevent distortion in the received signal and to assure proper stereo separation. In the FIG. 1 transmitter, the second order upper and lower sidebands are generated in balanced modulator 26, and their amplitude, with respect to the first order upper and lower sidebands and the carrier signal, can be easily determined by regulating the amplitude of the various signals supplied to adding circuit 32.

Figure 2:
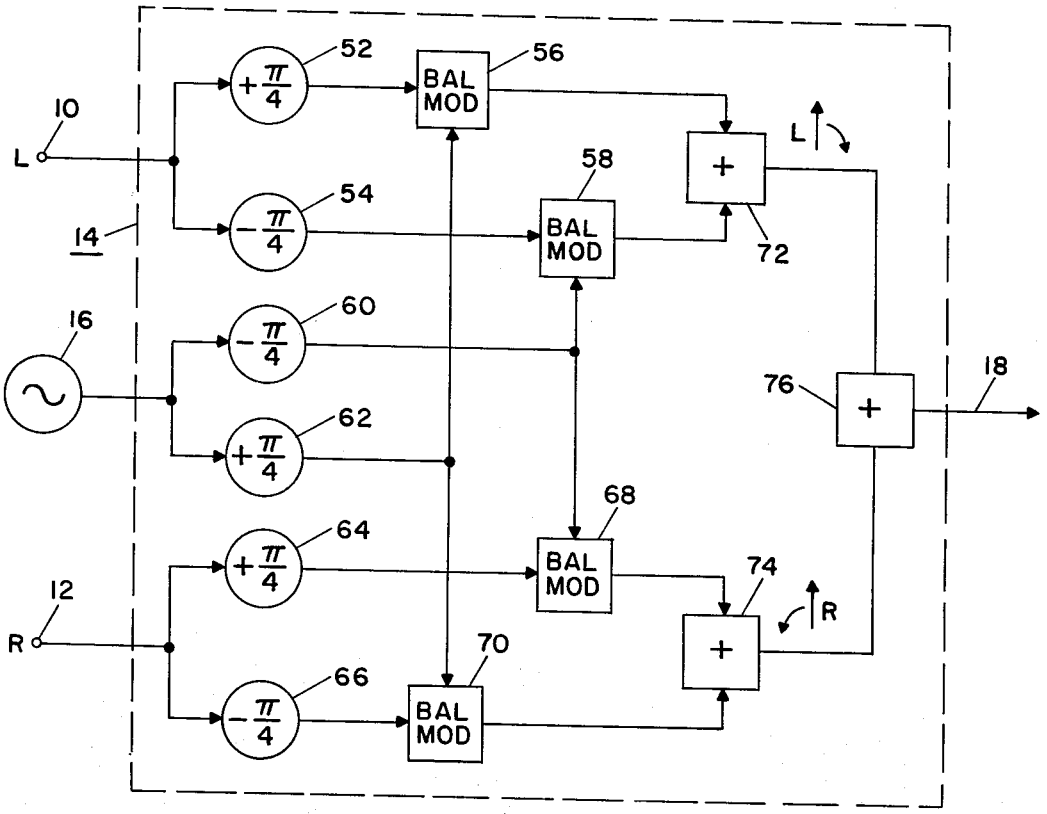
FIG. 2 is a block diagram of an ISB suppressed carrier signal generator useful in the AM stereo transmitter of FIG. 1.

FIG. 2 is a block diagram illustrating a conventional ISB suppressed carrier signal generator which may be useful as circuit 14 in the FIG. 1 transmitter. The ISB generator responds to L audio signals supplied to terminal 10 and R audio signals supplied to terminal 12. Each of the audio signals is supplied to respective phase shift networks 52, 54, 64, 66 which provide a relative phase shift of plus or minus $\pi/4$.

The design of such phase shift networks is well known in the art, as is illustrated by the following references: "Wideband Phase Shift Networks" by R. B. Dome, Electronics, Vol. 19, No. 12, pages 112–115, December 1946; "Design of RC Wide-Band 90-degree Phase Difference Networks," D. K. Weaver, Proc. IRE, Vol. 42, pages 671–676, April 1954.

The phase shifted audio signals are supplied to balanced modulators 56, 58, 68, 70 which are also supplied with phase shifted carrier signals from oscillator 16. The carrier signals are phase shifted by plus and minus $\pi/4$ in phase shifters 62 and 60, respectively. The outputs of the pairs of balanced modulators for each of the L and R audio signals are added in adding circuits 72 and 74, the outputs of which are lower and upper sidebands, respectively, with amplitude proportional to the L and R audio signals. Thus, the output of adding circuit 72 is a lower side-band whose amplitude is proportional to the amplitude of the L signal and whose frequency is equal to the difference between the carrier frequency and the frequency of the L signal. Likewise, the output of adder 74 is an upper sideband whose frequency is the sum of the carrier frequency and the frequency of the R audio signal and whose amplitude is proportional to the amplitude of the R audio signal.

The outputs of adders 72 and 74 are combined in adder 76 to form the first intermediate signal which is an ISB suppressed carrier signal having lower and upper sidebands corresponding to the L and R audio signals, respectively, and having a suppressed carrier. Only first order sidebands are present. This signal is supplied via lead 18 in the transmitter of FIG. 1 to demodulator 20, modulator 26 and phase shift network 30.

It should be noted that the ISB suppressed carrier signal generator 14 which is illustrated in FIG. 2 makes use of components which are substantially matched in phase so that the upper and lower sidebands have substantially identical phase and amplitude for audio signals of the same phase and amplitude. This characteristic of the ISB suppressed carrier generator is necessary so that the demodulated component output from product demodulator 20 vanishes when the L and R signals are equal. Those skilled in the art will recognize that other ISB suppressed carrier signal generators could be used, but where the signal generator includes filter circuits, it is necessary that the filters be phase-balanced to maintain the phase and amplitude equality which will cause the output from product demodulator 20 to vanish for equal L and R signals.

An alternative to the form of transmitter shown in FIG. 1 is available wherein simplicity and reduction in undesired spectral components are achieved by sacrificing slight envelope distortion. The alternative configuration would eliminate elements 38, 40, 42, 44, 46, 48 and 50 in FIG. 1 and instead simply provide linear amplification and frequency conversion of the output signal from summation circuit 32. This would introduce approximately 3% envelope distortion at 100% envelope modulation or approximately 1.5% envelope distortion at 50% envelope modulation.

While there has been described what is believed to be the preferred embodiment of the invention, those skilled in the art will recognize that other and further modifications may be made thereto without departing from the spirit of the invention, and it is intended to claim all such embodiments as fall within the true scope of the invention.

I claim:

1. In an independent sideband (ISB) AM stereo transmitter, a phase modulator, comprising:

an ISB, suppressed carrier signal generator, responsive to supplied stereo signals L and R, and a supplied carrier signal, for modulating said carrier and generating a first signal having upper and lower first order sidebands separately modulated by said L and R signals and a suppressed carrier;

means, responsive to said first signal and said carrier signal, for demodulating the quadrature component of said first signal to form a second signal;

means for modulating said first signal with said second signal to form a third signal, said third signal having carrier and first and second order sideband components;

means for combining said carrier signal, said first signal and said third signal with selected amplitudes and phases to form a fourth signal;

and a limiter for removing amplitude modulation components of said fourth signal thereby to provide a phase modulated signal having a carrier and first and second order sideband components.

2. A phase modulator as specified in claim 1 wherein said demodulator comprises a phase shifter for shifting the phase of said carrier by ($\pi/2$) to form a quadrature phase carrier and a product demodulator responsive to said first signal and said quadrature carrier.

3. A phase modulator as specified in claim 1 wherein said combining means includes means for shifting the phase of said carrier and said first signal by ($\pi/2$).

4. A phase modulator as specified in claim 1 wherein said combining means includes means for adjusting the amplitude of said carrier signal.

5. Apparatus for generating an independent sideband (ISB) AM stereo signal, responsive to supplied first and second distinct audio signals for generating a modulated signal having first and second order upper sidebands representative of said first audio signal and first and second order lower sidebands representative of said second audio signal, and responsive to supplied first and second identical audio signals for generating a modulated signal having substantially only first order upper and lower sidebands representative of said audio signals, comprising:

means for generating a carrier signal;

first modulating means, responsive to said first and second audio signals, for modulating said carrier signal to generate a first intermediate signal comprising a suppressed carrier signal having upper and lower first order sidebands representative of said first and second audio signals;

demodulating means, responsive to said carrier signal and said first intermediate signal for generating a second intermediate signal representative of the difference between said first and second audio signals;

second modulating means, responsive to said second intermediate signal, for modulating said first intermediate signal to generate a third intermediate signal having a carrier and first and second order upper and lower sidebands, said second order sidebands having an amplitude representative of the amplitude of said second intermediate signal and having zero amplitude for said identical first and second audio signals;

and means for combining said first and third intermediate signals and said carrier signal to form a combined modulated signal.

6. Apparatus as specified in claim 5 which additionally includes means for limiting said combined signal to form a phase-modulated signal, said phase-modulated signal comprising a carrier and first and second order upper and lower sidebands for said distinct audio signals, and comprising substantially only a carrier for said identical audio signals;

and means for adding said first and second audio signals to form a combined audio signal and modulating said phase modulated signal with said combined audio signal to form a final modulated signal.

7. Apparatus as specified in claim 5 wherein said demodulating means comprises a phase shifter for shifting the phase of said carrier by ($\pi/2$) and a product demodulator responsive to said first intermediate signal and said phase shifted carrier.

8. Apparatus as specified in claim 6 wherein said means for adding said first and second audio signals includes means for shifting the phase of said combined audio signal to correspond to the phase of the modulation of said phase-modulated signal.

* * * * *